US006116706A

United States Patent [19]

Pomerleau et al.

[11] Patent Number: 6,116,706

[45] Date of Patent: Sep. 12, 2000

[54] DRAWER GLIDE FOR DRAWER SLIDE ASSEMBLY

[75] Inventors: Lawrence J. Pomerleau, Lake Zurich; Burton F. Mendelson; Charles H. Dresner, both of Northbrook; Christopher V. Conley; Cira V. Conley, both of Chicago; Michael S. Garner, Northbrook, all of Ill.

[73] Assignee: Kenlin Group, Inc., Highland Park, Ill.

[21] Appl. No.: 09/348,780

[22] Filed: Jul. 7, 1999

[51] Int. Cl.[7] ..... A47B 88/00

[52] U.S. Cl. ..... 312/334.31; 312/334.36; 312/348.2

[58] Field of Search ..... 312/334.27, 334.29, 312/334.31, 334.32, 334.34, 334.4, 334.5; 248/298.1, 295.11, 424

[56] References Cited

U.S. PATENT DOCUMENTS

| | | | |
|---|---|---|---|
| Re. 32,134 | 5/1986 | Gutner et al. . | |
| 3,201,187 | 8/1965 | Reiss, Sr. et al. | 312/334.34 X |
| 3,328,107 | 6/1967 | Gutner | 312/334.27 X |
| 3,477,770 | 11/1969 | Niemi | 312/334.27 X |
| 4,389,079 | 6/1983 | Cosme . | |
| 4,441,773 | 4/1984 | Leiper . | |
| 4,501,453 | 2/1985 | Gutner et al. . | |
| 4,534,600 | 8/1985 | Cosme . | |
| 4,834,555 | 5/1989 | Grass . | |
| 4,890,938 | 1/1990 | Allen et al. . | |
| 5,011,242 | 4/1991 | Cosme . | |
| 5,243,736 | 9/1993 | Cannaday et al. . | |
| 5,257,861 | 11/1993 | Domenig et al. . | |
| 5,265,953 | 11/1993 | Rock et al. . | |
| 5,403,097 | 4/1995 | Woof . | |
| 5,664,855 | 9/1997 | Lautenschlager et al. . | |
| 5,785,401 | 7/1998 | Bowyer et al. . | |

OTHER PUBLICATIONS

1995 Kenlin products information guide RITE–TRAK® Drawer Guide System Youth Group Model; Technical Sheet.

Handy Button Machine Company Buyer's Guide, dated Sep. 1994, p. 4.

*Primary Examiner*—Jose V. Chen
*Assistant Examiner*—Michael J. Fisher
*Attorney, Agent, or Firm*—Tilton, Fallon, Lungmus & Chestnut

[57] ABSTRACT

An improved drawer glide for a drawer slide assembly provides drawer slide securement structure taking the form of an internal recess that securely receives a rear portion of an elongated metal drawer slide extending past a rear panel of a drawer. By providing the recess within the drawer glide as drawer slide securement structure, a range of lengths of drawer slides may be used for a given drawer length, significantly reducing the number of different sizes of drawer slides required to meet demands of the furniture industry. The improved drawer glide also includes internal reinforcement structure in the form of an imbedded metal plate.

13 Claims, 3 Drawing Sheets

DRAWER GLIDE FOR DRAWER SLIDE ASSEMBLY

BACKGROUND

1. Field of the Invention

This invention relates generally to furniture drawer slide assemblies and, more specifically, to an improved drawer glide that can be used with a variety of lengths of drawer slides, thereby reducing the number of different lengths of drawer slides required for use with drawers of various lengths.

2. Description of the Prior Art

In order to improve the ease of sliding of wood drawers, many furniture manufacturers have adopted the use of metal drawer slide assemblies, which utilize an elongated stationary lower metal drawer guide secured to the inside structure of the furniture article, an elongated upper metal drawer slide secured to the bottom of a drawer at the front and rear ends of the drawer, and a plastic drawer glide mounted to the rear wall of a drawer to facilitate movement of the drawer along the lower metal drawer guide. In most conventional drawer slide assemblies, the lower metal drawer guide consists of a generally U-shaped (or T-shaped) metal rail in cross-section, having flanges projecting horizontally outwardly from the upper ends thereof. The upper metal drawer slide is generally C-shaped in cross-section and has an integral, upwardly-extending metal tab member at the rear end thereof that is secured to the rear wall of the drawer. A typical arrangement of such conventional drawer slide assemblies is shown in co-owned U.S. Pat. Nos. Re. 32,134 and 4,501,452.

A plastic stop member is also provided at or near the front end of the elongated metal drawer guide that serves to prevent the drawer from being prematurely or inadvertently pulled out of the associated furniture unit. The plastic drawer glide is provided with a pair of opposing ways or runners that provide plastic-to-metal, as opposed to metal-to-metal, bearing surface to facilitate movement of the drawer along the elongated drawer guide. The opposing ways receive and ride along the outwardly projecting horizontal flanges of the drawer guide. A gap in the drawer glide just above the opposing ways can desirably barely accommodate the horizontal projections of the plastic stop member with no interference, so that the drawer can be inserted in the furniture unit with the stop and the drawer glide already installed. This gap also allows the drawer to be removed from the furniture unit, but only upon the use of sufficient force to squeeze the horizontal projections of the stop member into the gap of the drawer glide. Thus, the stop provides a warning to a user that the drawer is about to be pulled out of the furniture unit, and application of additional force will cause the drawer glide to pass beyond the stop.

A major shortcoming of the conventional drawer slide assembly is the need to provide drawer length-specific sizes of drawer slides. One reason that drawer length-specific sizes of drawer slides are required is that the upwardly-extending tab member at the rear end of the drawer slide provides the primary means for securing the rear end of the drawer slide to the bottom of the drawer. As a result, the drawer slide could not have a length that would cause the tab member to extend past the rear wall of the drawer.

The drawer glide of many conventional drawer slide assemblies is a plastic part that utilizes an elongated integral plastic male extension that is received inside the rear end of the C-shaped drawer slide. The plastic extension of the drawer glide is inserted into the rear end of the C-shaped drawer slide until a front face of the drawer glide lies flush against the upwardly-extending tab member at the rear end of the drawer slide. Screws or other suitable fasteners are used to secure both the drawer glide and the upwardly-extending tab member to the rear wall of the drawer. While the plastic extension of the drawer glide may provide some incidental support to the drawer slide, the primary purpose of the plastic extension is to provide a plastic bearing surface to facilitate movement of the drawer along the drawer guide.

By only being able to match a specific length of drawer slide with a given drawer length, a large array of drawer slides having various lengths must be manufactured to meet the demands of the furniture industry. This increases the number of stock-keeping units ("SKU's") that must be provided by the supplier of drawer slide assemblies.

The upwardly-extending tab portion also requires additional working of the metal during manufacture of the drawer slide, which adds to production time and cost. Similarly, there are disadvantages of conventional metal drawer slides due to the cost of complicated tooling for stamping manufacturing processes, or alternatively, where the metal drawer slides are roll formed, not only is complicated tooling required, but also, production time is detrimentally slowed down. The present invention overcomes these shortcomings by eliminating the upwardly-extending tab portion of the metal drawer slide and changing the manner in which the drawer glide couples with the rear end of the drawer slide and the rear wall of the drawer.

SUMMARY OF THE INVENTION

It is the object of the present invention to provide a drawer slide assembly that can be used on a variety of lengths of drawers, so as to significantly reduce the number of SKU's, or different lengths of drawer slides, required to meet the demands of the furniture industry. Instead of having a drawer slide that terminates at an upwardly-extending tab member at the rear end of the metal drawer slide, the present invention requires the drawer slide to extend past the rear wall of the drawer.

The object of the present invention is achieved by means of an improved drawer glide, wherein instead of a male plastic forwardly-projecting extension of the drawer glide, the drawer glide is provided with a female recess in its front face. The metal drawer slide projects rearwardly beyond the rear wall of the drawer and is received in the female recess of the drawer glide. In a first embodiment of the improved drawer glide, the female recess is present instead of the male plastic extension. The female recess is of sufficient depth to accommodate a length of a drawer slide that extends as much as ¼ inch beyond the rear wall of the drawer. According to this embodiment, the drawer slides can thus be provided with a manufacturing tolerance of 1/16", as opposed to needing more exact drawer-length specific drawer slides.

In a most preferred embodiment, the recess of the plastic drawer glide is elongated, having sufficient depth to accommodate a length of drawer slide that extends as much as ½ inch beyond the rear wall of the drawer, whereby a greater variety of lengths of drawers can be used with a given drawer slide. The drawer slides can vary in ¼" increments, resulting in fewer drawer slide SKU's than the first embodiment of the present invention.

A further improvement over conventional drawer glides is the use of a metal insert plate within the plastic drawer glide. The metal insert plate provides internal rigidity and strength to the drawer glide, achieving vastly stronger drawer glide than conventional entirely plastic drawer glides, and eliminating the need for extra plastic rigidity members found on conventional drawer glides. The plastic drawer glides of the present invention are overmolded onto the metal insert plates. Further features and benefits of the present invention will be appreciated by reference to the drawings and in the following detailed description of the preferred embodiments.

DETAILED DESCRIPTION OF THE PREFERRED EMBODIMENTS

Conventional Drawer Slide Assemblies

Figure 1:
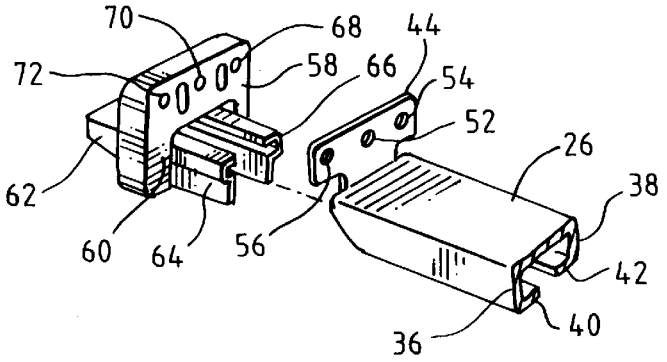
FIG. 1 PRIOR ART
FIG. 1 is a fragmentary exploded front perspective view of a conventional prior art drawer glide and drawer slide combination.
Figure 2:
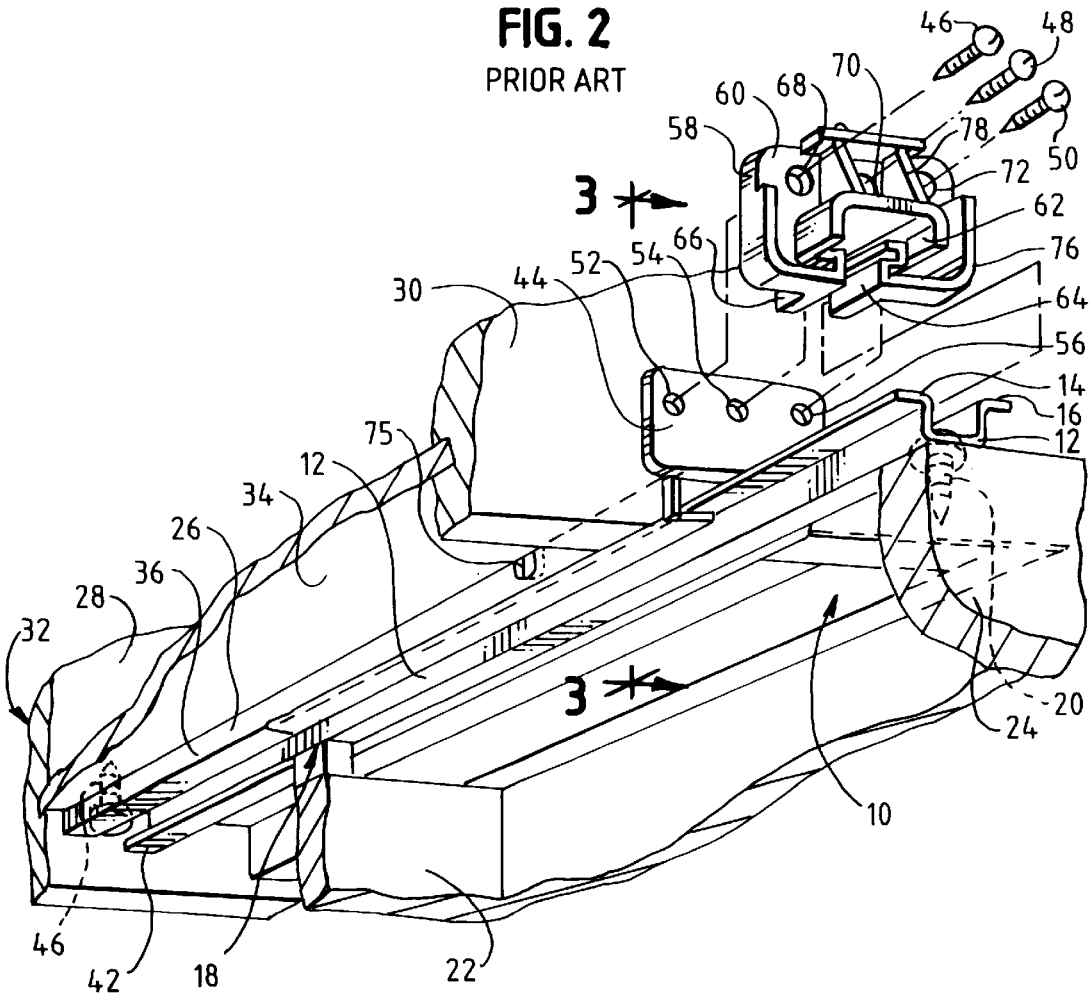
FIG. 2 PRIOR ART
FIG. 2 is a partially exploded rear perspective view, broken away, of a conventional prior art drawer slide assembly.
Figure 3:
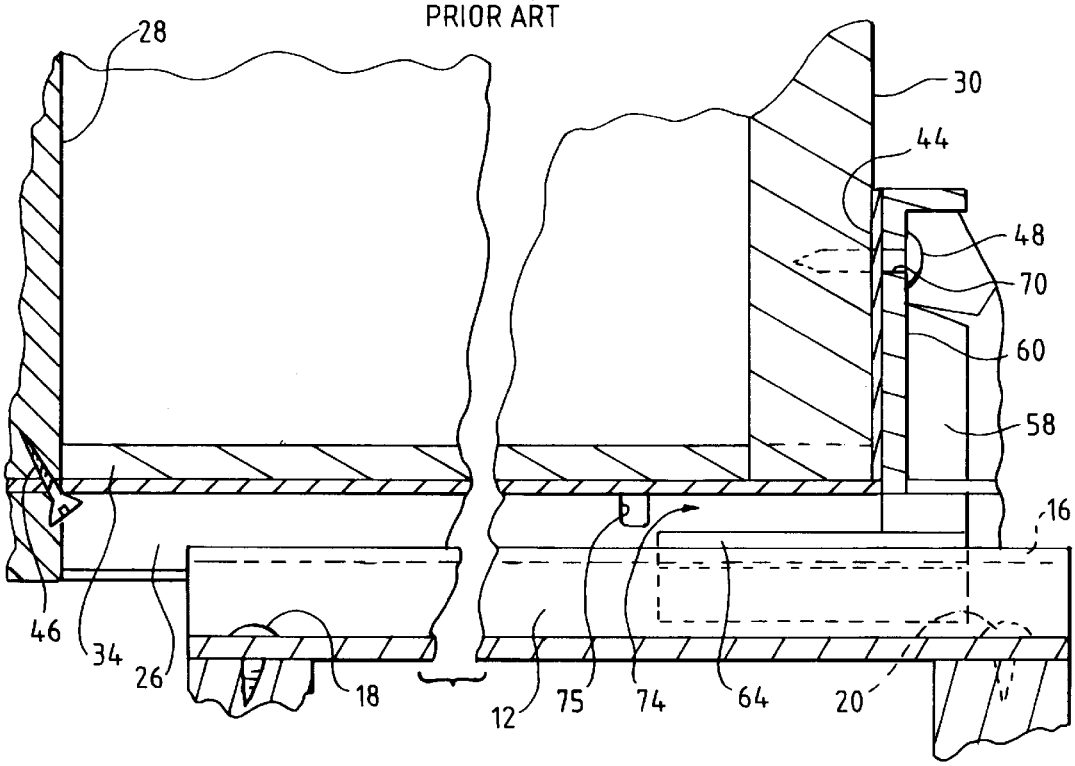
FIG. 3 PRIOR ART
FIG. 3 is a cross-section taken along lines 3—3 of FIG. 2 of the prior art drawer slide assembly shown in FIG. 2.
Figure 4:
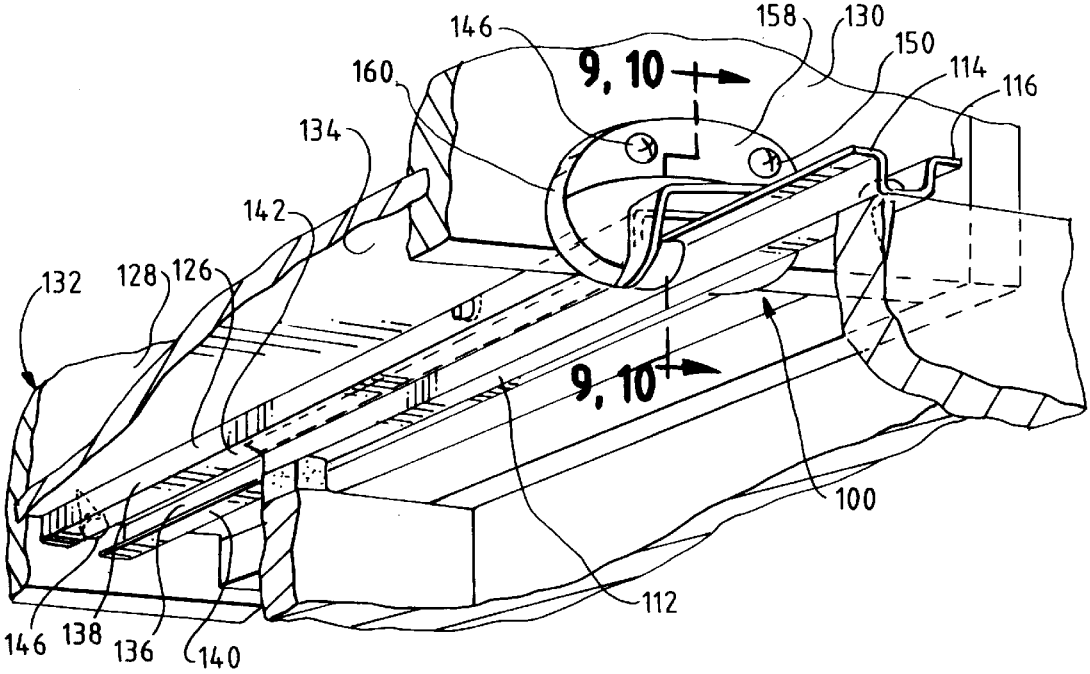
FIG. 4 is a rear perspective view, broken away, of a drawer slide assembly incorporating a first embodiment of the improved drawer glide of the present invention.
Figure 5:
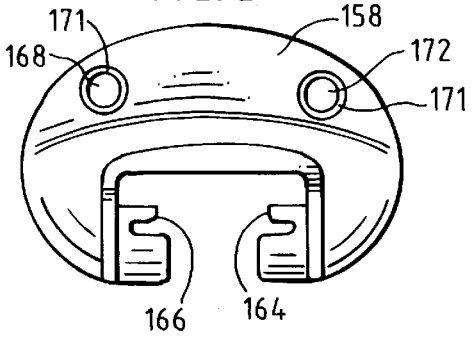
FIG. 5 is a rear plan view of the improved drawer glide shown in FIG. 4.
Figure 6:
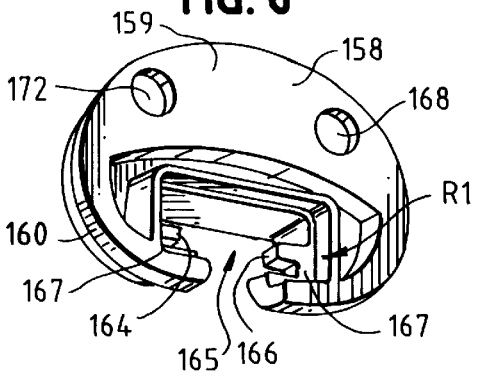
FIG. 6 is a front perspective view of the improved drawer glide shown in FIG. 4.

Referring first to FIGS. 1–3, a conventional drawer slide assembly 10 is shown to represent what exists in the prior art. The conventional drawer slide assembly 10 includes a stationary elongated metal drawer guide 12 that is comprised of a rail having a substantially U-shaped cross-section, with horizontal, outwardly projecting flanges 14, 16. The drawer guide 12 is secured, for example by wood screws 18, 20, to the front drawer aperture cross support 22, and rear drawer aperture cross support 24, of a furniture unit. An elongated metal drawer slide 26 is secured to the front wall 28 and rear wall 30 of a drawer 32 along the bottom wall 34 of the drawer 32. The drawer slide 26 is C-shaped in cross-section, having vertical side walls 36, 38 and inwardly-directed horizontal flanges 40, 42.

The prior art drawer slide 26 is also equipped with an integral flange or tab 44 that extends vertically up the rear wall panel 30 of the drawer 32. A wood screw 46 or a similar fastening means is used to secure the drawer slide 26 to the front wall 28 of the drawer 32 at the corner of the front wall 28 and the bottom panel 34. The rear end of the prior art drawer slide 26 is secured to the rear wall panel 30 by wood screws 46, 48, 50 (or similar fastening means) that pass through screwreceiving apertures 52, 54, 56 in the integral tab 44.

In order to prevent direct, metal-to-metal contact of the drawer slide 26 along the drawer guide 12, a plastic drawer glide 58 is provided in the prior art drawer slide assembly 10 at the rear wall panel 30 of the drawer 32. The drawer glide 58 consists of a wall member 60, a rearward integral extension 62, and a pair of forwardly extending opposing ways 64, 66. The opposing ways 64, 66 are essentially question mark shaped in cross section. The drawer glide 58 is secured to the rear wall 30 by wood screws 46, 48, 50 (or by similar fastening means). The wood screws 46, 48, 50 pass through screw receiving apertures 68, 70, 72 in the wall member 60, with the screw receiving apertures 68, 70, 72 being axially aligned with the screw receiving apertures 52, 54, 56 in the integral tab 44 of the drawer slide 26.

The opposing ways 64, 66 of the drawer glide 58 receive the horizontal flanges 14, 16 of the drawer guide 12 and ride along the drawer guide 12. A gap or opening 74 in the drawer glide 58 located immediately above the opposing ways 64, 66 permits the drawer glide to pass over a plastic stop member (not shown), located near the front of the drawer guide 12. A pair of opposing, inwardly-directed stops 75 are provided on the vertical side walls 36, 38 of the drawer slide 26, which serve to temporarily stop the drawer glide 58, so the user has some warning or resistance before the drawer 32 is completely removed from the furniture unit, but removal of the drawer is still possible by applying sufficient pulling force to the drawer 32 so as to pull the stop member through the gap 74, and thus pull the drawer glide 58 and drawer slide 26 past the stop member. In other words, the stops 75 in the side walls 36, 38 the drawer slide 26 provide resistance to warn the user that the drawer 32 is approaching the front end of the drawer slide 26. In order to provide some strength to conventional the drawer glide 58, there are integral plastic rigidifying wall members, for example wall members 76, 78, on the exterior thereof. As is explained in greater detail below, the drawer glide of the present invention is provided with a metal insert that vastly improves the strength of the drawer glide, as compared to conventional entirely plastic drawer glides.

Because the drawer slide 26 incorporates an integral tab 44 fastened to the rear wall panel 30 as the primary means of securing the drawer slide 26 to the drawer 32, conventional drawer slides have had to be drawer-length specific. Relatively high tolerances are required to ensure that the length of the drawer slide 26 corresponds to the length of the drawer 32 so that the tab 44 lies flush along the rear wall panel 30. Although the forwardly-extending opposing ways 64, 66 of the plastic drawer glide 58 extend into a rear end of the drawer slide 26, the opposing ways 64, 66 do not provide a substantial means of securing the rear end of the drawer slide 26 to the drawer 32. Instead, wood screws 46, 48, 50 must be used.

Improved Drawer Slide Assemblies of the Present Invention

Turning now to FIGS. 4–10, the present invention provides a drawer slide assembly 100 that can accommodate a range of lengths of drawer slides for a given drawer length, resulting in a significant reduction in SKU's for suppliers of drawer slide assemblies, inasmuch as the present invention permits the use of a single drawer slide length to fit drawers in an array of specific given drawer lengths. The present invention utilizes an improved drawer glide 158. The drawer slide assembly of the present invention still utilizes an elongated U-shaped metal drawer guide 112 having horizontal outwardly-projecting flanges 114, 116. A drawer slide 126 is also provided.

Figure 9:
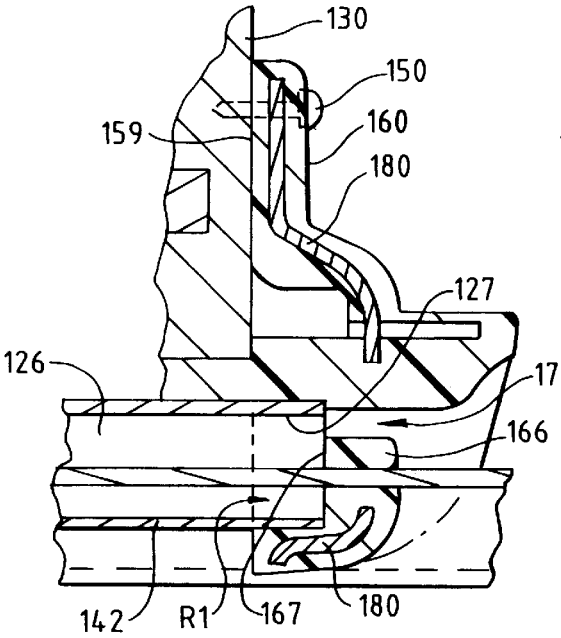
FIG. 9 is an enlarged cross-section taken along lines 9—9 of FIG. 4.
Figure 10:
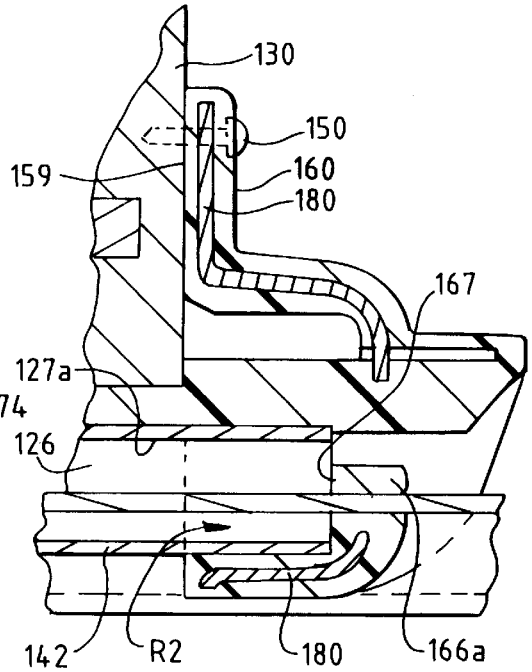
FIG. 10 is an enlarged cross-section, similar to the view shown in FIG. 9, but showing an alternate embodiment of the improved drawer glide of the present invention, taken along lines 10—10 of FIG. 4.

The drawer slide 126 is an elongated metal rail that is C-shaped in cross-section, having vertical side walls 136, 138 and inwardly projecting flanges 140, 142. Notably, the drawer slide 126 lacks an integral tab at the rear end thereof. Instead, the drawer slide 126 has a rear-most portion 127 that extends rearwardly past the rear wall panel 130 of the drawer 132, as best shown in FIGS. 9 and 10. The drawer glide 158 has screw-receiving apertures 168, 172, in a wall member 160 through which wood screws 146, 150 (or similar fastening means) pass to secure the drawer glide 158 directly to the rear wall 130 of the drawer 132. Counter-sunk screw-head receiving circular bores 171 in a rear side of the drawer glide 158 are provided immediately about the screw-receiving apertures 168, 172 to provide a more flush exterior surface to the drawer glide 158 when the wood screws 146, 150 are in place. There is no integral tab at the rear end of the drawer slide 126, thus the front face 159 of the drawer glide 158 lies flush against the rear wall 130, without any intermediate metal tab portion.

The front end of the drawer slide 126 is secured in a conventional manner by a screw 146 or similar fastening means to the bottom wall 134 of the drawer 132, preferably at the corner of the bottom wall 134 and the front wall 128 of the drawer 132. The improved drawer guide 158 of the present invention advantageously provides a means for securing the rear-most portion 127 of the drawer slide 126 to the drawer 132 without the need for an integral tab on the drawer slide 126. The securement means of the improved drawer glide 158 advantageously includes a C-shaped, downwardly-open aperture 165 that accommodates the rear-most portion 127 of the C-shaped drawer slide 126, which extends past the rear wall 130 of the drawer 132, thus solving the problem of the prior art wherein drawer slides had to be drawer-length specific. Most preferably, the entire cross-section of the drawer slide 126 extends past the rear wall 130 of the drawer 132.

A recess R1 (see FIG. 9) is provided within the drawer glide 158. The recess R1 extends rearwardly from the front face 159 and securely receives, preferably in a press fit, the portion 127 of the drawer slide 126 that extends rearwardly of the rear wall 130. Advantageously, the recess R1 is shaped to accommodate the rearmost portion 127 that is an extension of the entire cross-section of the drawer slide 126. By so accommodating the entire C-shaped cross-section of the drawer slide 126, the recess R1 allows for the drawer slide 126 to be manufactured without special additional cutting, rolling, or stamping operations to form any rearwardly extending adapter or tab portion at the rear end of the drawer slide 126.

The combination of the securement of this rear-most portion 127 of the drawer slide 126 in the recess R1, and the securement of the drawer glide 158 to the rear wall 130 via wood screws 146, 150 (or similar fastening means) effectively secures the rear of the drawer slide 126 to the bottom panel 134 of the drawer 132. As a result, a given drawer slide 126 can be used on a variety of lengths of drawers.

Production time in the shaping of drawer slides 126 is also advantageously reduced, because there is no need to form the integral tab members found in the drawer slide assemblies of the prior art. By way of example only, a suitable depth for the recess R1, i.e. the distance from the forward wall 167 of the opposing ways 164, 166 and a front face 159 of the drawer glide 158, is approximately ¼ inch. The maximum depth for the recess R1 is limited by the depth of the space behind the drawer 132 in the associated furniture unit when the drawer 132 is completely closed. Thus, the longest the recess R1 can suitably be in a particular drawer is a dimension such that the drawer glide 158 would not prevent complete closure of the drawer 132.

Figure 7:
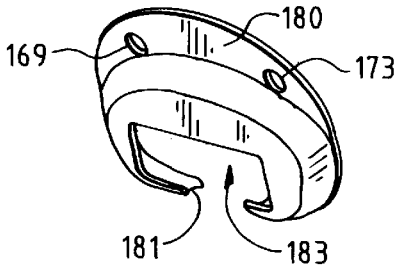
FIG. 7 is a rear perspective view of a metal insert plate used in the improved drawer glide of the present invention.
Figure 8:
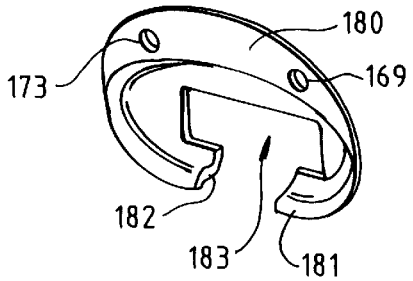
FIG. 8 is a front perspective view of the metal insert plate shown in FIG. 7.

The drawer glide 126 of the present invention is also advantageously internally reinforced by a metal plate 180 imbedded within the drawer glide, shown in FIGS. 7 and 8. The drawer glide 126 is preferably manufactured by over-molding of the plastic exterior directly over the metal plate 180. The metal plate 180 is provided with apertures 169, 173 that align coaxially with screw-receiving apertures 168, 172, so the screws 146, 150 do not have to pierce through the metal plate 180 to secure the drawer glide 158 to the rear wall 130. The metal plate 180 is provided with a generally C-shaped, downwardly-open aperture 183 that serves to reinforce the generally C-shaped aperture 165 of the drawer glide 158. Advantageously, the metal plate 180 eliminates the need for rigidifying wall members on the exterior of the drawer glide 158.

The drawer glide 158 further includes opposing ways 164, 166 that are essentially question mark shaped in cross-section and extend inwardly from side walls of the C-shaped aperture 165. The forward-most, vertical end wall 167 of each of the opposing ways 164, 166 terminates rearwardly of the front face 159 of the drawer glide 158, and defines the rear end of the recess R1. Importantly, this means the rear-most portion 127 of the drawer slide 126 does not extend past the forward-most end wall 167 of the opposing ways 164, 166.

The opposing ways 164, 166 prevent direct metal-to-metal contact between the drawer slide 126 and the drawer guide 112. The opposing ways 164, 166 receive the horizontal, outwardly projecting flanges 114, 116 of the drawer guide 112, providing plastic-to-metal contact with the drawer guide 112, thereby facilitating movement of the drawer 132 along the drawer guide 112. The metal plate 180 has lower portions 181, 182 that are S-shaped in cross-section, which provide internal reinforcement to the opposing ways 164, 166. Advantageously, the lower portions 181, 182 also provide enhanced support to the drawer slide 126, which is important to accommodate the weight of the contents of the drawer 132.

A gap 174 in the drawer glide 158 immediately above the top surface of the opposing ways 164, 166 allows the drawer glide 158 to pass over a preferably plastic stop member (not shown) located near the front end of the drawer guide 112 without resistance.

In a more preferred embodiment of the invention, shown in FIG. 10, the recess R2 is an elongated recess, to accept a greater variety of lengths of drawer slides. In this embodiment, the opposing ways **166*a* have a forward wall 167*a* that is more remote in a rearward direction from the rear wall panel 130 of the drawer 132 than in the previous embodiment. As a result, the drawer slide 126 can have a rear-most portion 127*a* that extends farther past the rear wall panel 130** than the previous embodiment.

Preferably, the depth of this elongated or deeper recess is at least ½ inch, which allows for use of ¼" increments in the sizing of drawer slides. Again, the maximum suitable depth for the recess R2 would be a depth such that the drawer glide 158 does not prevent complete closure of the drawer 132 in its associated furniture unit. This embodiment results a significant reduction in the amount of SKU's, because the recess R2 makes it unnecessary for the drawer slide to be drawer-length specific.

While the present invention has been described with respect to various embodiments thereof, it will be appreciated by those of ordinary skill in the art that modifications may be made thereto that are still within the scope of the appended claims.

What is claimed is:

1. An improved drawer glide for a drawer slide assembly comprising:

a wall member;

a pair of opposing ways for receiving a pair of horizontal flanges of an elongated drawer guide;

drawer slide receiving means comprising a recess in said wall member, said recess extending rearwardly from a front face of said drawer alide and terminating at a forward wall end of said pair of opposing ways and said recess securely receiving a portion of a drawer slide extending rearwardly of said rear panel;

one or more screw receiving apertures in said wall member for facilitating means for securing the drawer glide to a rear panel of a drawer;

and internal reinforcement means imbedded therein.

2. The improved drawer glide of claim 1, wherein the internal reinforcement means comprises a metal reinforcement plate.

3. The improved drawer glide of claim 2, wherein said metal reinforcement plate includes one or more apertures therein that are coaxial with said one or more screw receiving apertures.

4. The improved drawer glide of claim 1, wherein said drawer slide receiving means accommodates an entire cross-section of said drawer slide.

5. An improved drawer slide assembly having an elongated metal drawer guide secured to a furniture unit, said elongated drawer guide being U-shaped in cross-section and having a pair of outwardly-directed horizontal flanges at an upper end thereof, an elongated metal drawer slide secured to a bottom panel of a drawer, and a plastic drawer glide secured to a rear panel of the drawer, the drawer glide having a pair of inwardly-directed opposing ways to receive said outwardly-directed horizontal flanges of the elongated metal drawer guide, the improvement comprising:

said drawer glide having a recess therein terminating at a front wall of said opposing ways; and a rear-most portion of said elongated metal drawer slide extending past said rear panel of the drawer and being securely received within said recess, and said rear-most portion of said elongated metal drawer slide being an extension of the entire cross-section of said drawer slide.

6. The improved drawer slide assembly of claim 5, wherein said drawer glide further includes internal reinforcement means.

7. The improved drawer slide assembly of claim 6, wherein said internal reinforcement means comprises a metal reinforcement plate imbedded in said drawer glide.

8. The improved drawer slide assembly of claim 7, wherein lower portions of said reinforcement plate provide internal reinforcement to said opposing ways and enhanced support for said drawer slide.

9. The improved drawer slide assembly of claim 5, wherein said recess of the drawer glide has a depth of at least ¼ inch from a front face of said drawer glide.

10. The improved drawer slide assembly of claim 5, wherein said recess of the drawer glide has a depth of at least ½ inch from a front face of said drawer glide, whereby the drawer glide can accommodate any of a plurality of given drawer slides having lengths that vary within ¼ inch of one another.

11. An drawer glide for a drawer slide assembly comprising:

a front face for abutting a rear panel of a drawer;

a pair of screw-receiving apertures in said front face for securing the drawer glide to said rear panel of the drawer;

a metal reinforcement member imbedded within the drawer glide and having a C-shaped, downwardly-open aperture therein, and a pair of apertures aligned coaxially with said screw-receiving apertures;

a C-shaped, downwardly-open aperture of the drawer glide to receive a corresponding C-shaped drawer slide member, said C-shaped aperture of the drawer glide including a pair of opposing ways projecting inwardly from side walls of said C-shaped aperture of the drawer glide, said opposing ways terminating rearwardly of said front face at forward-most vertical walls of the opposing ways, said side walls of the C-shaped aperture of the drawer glide and said forward-most vertical walls defining a recess in the drawer glide for securely receiving an end of said drawer slide member that extends rearwardly of said rear panel, whereby said drawer slide can be securely fastened to said rear panel by the drawer glide.

12. The drawer glide of claim 11, wherein each of the opposing ways include an elongated, inwardly open channel therein to slidably receive a horizontal, outwardly-projecting flange of a U-shaped drawer glide.

13. The drawer glide of claim 11, wherein said end of the drawer slide member is a rear-most projection of the entire cross-section of said drawer slide member.

* * * * *

UNITED STATES PATENT AND TRADEMARK OFFICE

CERTIFICATE OF CORRECTION

PATENT NO. : 6,116,706

DATED : September 12, 2000

INVENTOR(S) : Lawrence J. Pomerleau, et al.

It is certified that error appears in the above-indentified patent and that said Letters Patent is hereby corrected as shown below:

In claim 1, line 8, "alide" should read -- glide --.

Signed and Sealed this

Tenth Day of April, 2001

*Attest:*

Nicholas P. Godici

NICHOLAS P. GODICI

*Attesting Officer*

*Acting Director of the United States Patent and Trademark Office*